US012751565B2

(12) United States Patent
Ting et al.

(10) Patent No.: US 12,751,565 B2
(45) Date of Patent: Oct. 6, 2026

(54) SMART SHELVING UNIT WITH MARKETING DISPLAY

(71) Applicant: Green Cubes Technology, LLC, Kokomo, IN (US)

(72) Inventors: Calvin Ting, Kokomo, IN (US); Goo Sung, Kokomo, IN (US); Mohammed Alobaidi, Kokomo, IN (US)

(73) Assignee: Green Cubes Technology, LLC, Kokomo, IN (US)

( * ) Notice: Subject to any disclaimer, the term of this patent is extended or adjusted under 35 U.S.C. 154(b) by 642 days.

(21) Appl. No.: 16/892,601

(22) Filed: Jun. 4, 2020

(65) Prior Publication Data

US 2020/0383499 A1 Dec. 10, 2020

Related U.S. Application Data

(60) Provisional application No. 62/857,256, filed on Jun. 4, 2019.

(51) Int. Cl.
*A47F 10/02* (2006.01)
*A47F 5/00* (2006.01)
(Continued)

(52) U.S. Cl.
CPC ..... *A47F 10/02* (2013.01); *A47F 5/0043* (2013.01); *A47F 7/28* (2013.01); *A47F 2010/005* (2013.01); *A47F 2010/025* (2013.01)

(58) Field of Classification Search
CPC ..... A47F 10/02; A47F 5/0043; A47F 7/28; A47F 2010/005; A47F 2010/025; A47F 5/108; A47F 10/00; G06Q 30/0241; G06Q 30/06; G06Q 10/087; G06Q 10/0872; G06Q 10/08724; G06Q 10/08726;
(Continued)

(56) References Cited

U.S. PATENT DOCUMENTS 5,631,536 A * 5/1997 Tseng ..... B60L 53/305 320/137
5,646,616 A * 7/1997 Komatsu ..... B65G 1/1375 340/5.91
(Continued)

*Primary Examiner* — Jeffrey A Shapiro
(74) *Attorney, Agent, or Firm* — Reichel Stohry Dean LLP; Mark C. Reichel; Natalie J. Dean

(57) ABSTRACT

Disclosed herein are mobile battery powered smart shelving units, systems, and methods for optimizing retail operations using these smart shelving units. These smart shelving units may comprise any combination of at least one: wheeled frame, display screen, a battery, a computer, a Wi-Fi module, a low frequency Bluetooth module, and an RFID reader/scanner, and an interactive touch screen. A system for optimizing retail operations may comprise a central computer hub configured for wireless communication with the computer and Wi-Fi module on the smart shelving unit(s) to continually exchange information related to the merchandise thereon, such as updated pricing, quantity, marketing, demonstrations, etc. The smart shelving units can communicate wirelessly in real time with a plurality of other smart shelving units, a central computer hub, and other low frequency Bluetooth devices nearby. In some embodiments, these smart shelving units may also be used to sell food and beverages.

19 Claims, 6 Drawing Sheets

(51) Int. Cl.
*A47F 7/28* (2006.01)
*A47F 10/00* (2006.01)

(58) Field of Classification Search
CPC ..... G06Q 10/08728; G06Q 10/0874; G06Q 10/083; G06Q 10/08741; G06Q 10/08743; G06Q 10/08744; G06Q 10/0877; G06Q 10/08772; G06Q 10/08774; G06Q 10/08776; G06Q 10/08778; G06Q 30/0633; G06Q 30/0635; G06Q 30/0631; G06Q 30/0261; G07F 9/023; G07F 9/0235; B62B 5/0096; G07G 1/0036
See application file for complete search history.

(56) References Cited

U.S. PATENT DOCUMENTS 6,834,452 B2 * 12/2004 Martin ..... G09F 13/22 40/544
10,108,157 B1 * 10/2018 Raghavan ..... G05B 15/02
10,192,157 B2 * 1/2019 Cote ..... G06K 19/0702
2002/0093426 A1 * 7/2002 Jackson ..... G06Q 30/0225 340/10.51
2002/0100660 A1 * 8/2002 Stieber ..... G07D 11/40 194/215
2003/0001726 A1 * 1/2003 Moore ..... G06K 17/00 340/10.3
2004/0232092 A1 * 11/2004 Cash ..... A47B 73/008 211/74
2005/0040934 A1 * 2/2005 Shanton ..... H04L 67/04 340/5.92
2005/0171854 A1 * 8/2005 Lyon ..... G06Q 20/209 705/24
2006/0074763 A1 * 4/2006 Schmid ..... G06Q 30/0633 705/26.8
2008/0077511 A1 * 3/2008 Zimmerman ..... G05D 1/0246 705/28
2008/0106377 A1 * 5/2008 Flores ..... G06Q 10/087 340/5.92
2008/0302607 A1 * 12/2008 Kaplan ..... A47F 9/04 186/61
2009/0182623 A1 * 7/2009 Baltimore ..... G06Q 30/0261 705/14.58
2009/0231135 A1 * 9/2009 Chaves ..... G06Q 10/087 340/572.1
2010/0057245 A1 * 3/2010 Hironaka ..... G06Q 10/08 700/214
2013/0211977 A1 * 8/2013 Lyon ..... G06Q 10/0875 705/29
2014/0022140 A1 * 1/2014 Horst ..... H01Q 13/20 343/843
2014/0164122 A1 * 6/2014 Wissner-Gross ..... G06Q 30/0261 705/14.58
2014/0191037 A1 * 7/2014 Matsuhisa ..... G06K 7/1404 235/455
2015/0041616 A1 * 2/2015 Gentile ..... G06K 19/0723 248/550
2015/0099946 A1 * 4/2015 Sahin ..... G16H 50/20 600/301
2015/0194023 A1 * 7/2015 Brackenridge ..... G07G 1/0045 235/383
2015/0227127 A1 * 8/2015 Miller ..... G16H 20/13 700/244
2016/0078263 A1 * 3/2016 Zollinger ..... G06Q 10/087 340/10.1
2016/0210682 A1 * 7/2016 Kannan ..... G06Q 30/0633
2017/0039587 A1 * 2/2017 Dey ..... G06Q 30/0261
2017/0238700 A1 * 8/2017 Davis ..... B65D 19/44
2018/0027992 A1 * 2/2018 Schiffman ..... A47F 10/00
2018/0127212 A1 * 5/2018 Jarvis ..... G05D 1/0234
2018/0260868 A1 * 9/2018 Peterson ..... G06K 9/00771
2018/0276480 A1 * 9/2018 Peterson ..... G06K 9/00771
2019/0087862 A1 * 3/2019 Schiano ..... G06Q 30/0261
2019/0095933 A1 * 3/2019 Doherty ..... H04W 4/029
2019/0204897 A1 * 7/2019 Duron ..... G09F 3/204
2019/0236583 A1 * 8/2019 Hagen ..... G06Q 30/0635
2019/0295148 A1 * 9/2019 Lefkow ..... G06Q 10/0833
2020/0065748 A1 * 2/2020 Durkee ..... G06K 7/1408
2020/0126125 A1 * 4/2020 Sanjay ..... G06Q 30/0261
2020/0154246 A1 * 5/2020 Ganz ..... G06Q 30/0633
2020/0172138 A1 * 6/2020 Tolson ..... B62B 3/001
2020/0275059 A1 * 8/2020 De Bonet ..... G06V 10/141
2021/0012633 A1 * 1/2021 Gabara ..... G06Q 30/06
2021/0024112 A1 * 1/2021 Ting ..... G07G 1/009
2021/0125142 A1 * 4/2021 Bloom ..... G06K 19/0723
2021/0239511 A1 * 8/2021 Yoshinaga ..... G01G 19/12

* cited by examiner

SMART SHELVING UNIT WITH MARKETING DISPLAY

PRIORITY

The present application is related to, and claims the priority benefit of, U.S. Provisional Patent Application Ser. No. 62/857,256, filed Jun. 4, 2019, the contents of which are incorporated herein directly and by reference in their entirety.

BACKGROUND

Retail and department stores spend thousands of hours setting up retail or merchandise displays, stocking merchandise on shelves and hangers, and setting up marketing or advertising displays for that particular merchandise. They also spend tons of time tracking inventory, cleaning up misplaced items, and resupplying and/or restocking items. Some retail or merchandise shelves can plugged into outlets to provide electrical power for their marketing displays, lights, pricing displays, displays for advertising, or simply to power products for demonstrations.

The next generation of shelves should not only be powered, but battery powered and able to assist employees with tasks such as tracking inventory and restocking items. A smart shelving, storage, and/or display unit needs to be powered but it would be ideal to have the option to plug the display in, or for it be powered by a battery, thus making it more mobile. A battery powered display would allow stores to power and display items in areas that don't have permanent power, thus opening up their salesfloor options.

These improved smart shelving units may be equipped with RFID readers/scanners, WiFi modules, Bluetooth low frequency modules, computers, displays (touch and/or non-touch), cameras, sensors, and more. Because more stores are adding RFID tags to all of their merchandise, having RFID readers/scanners integrated into the smart shelving units can provide information to employees on what items are on the shelving/display unit and how many there are. These smart shelving units could help determine inventory levels, show when items are placed on the wrong shelf, and/or provide information on items needing to be restocked or replenished. These smart shelving units would then relay the information back to a central computer hub of the retail store, via a WiFi module for example, and then instruct, or direct, the store employees/staff accordingly, to help increase store employee efficiency.

Additionally, a computer within these smart shelving units could identify what items are being displayed and automatically run advertising or marketing for that specific merchandise on the display screen/touchscreen/television attached to that smart shelving unit. The smart shelving unit's computer may use the RFID readers/scanners and tags to identify the items on the shelf, cross reference a product database to find the corresponding advertising/marketing material, and finally play the advertising/marketing for that specific merchandise on the display or touchscreen of the smart shelving unit. When employees change or add new items to the smart shelving unit, the computer (in cooperation with the RFID readers/scanners, low frequency Bluetooth module, and WiFi module) would recognize the new RFID tags and begin advertising the new items (and the new price) on the television/screen/display of the smart shelving unit, thus significantly improving employee efficiency by reducing setup times for changing or adding new merchandise on the smart shelving retail displays.

The low frequency Bluetooth module on these improved smart shelving units will not only be able to recognize how many customers walk near the shelving unit, but could also determine how long they stand there, thus revealing data on how interested consumers are in specific products. The low frequency Bluetooth module could also be set up to push notifications to consumers based upon this data. For example, when a person walks into Example Retail Store (and they have Example Retail Store's app on their phone) and they walk within range of the first smart shelf unit, it could push them a notification (through the app) that says, "Welcome to Example Retail Store! Here's a list of today's deals . . . " From there, if the customer spent more than 10 seconds near a smart shelf unit (i.e., a particular item), it could make a note of that on their customer loyalty account. If the consumer doesn't end up buying the particular item (as the item would show up on their loyalty account if they buy it when they checkout), then it could remind them a week later with a coupon, something like: "Hey, we noticed you were looking at X product during your last visit. Here's a 10% off coupon for X product."

Another benefit of mobile battery powered smart shelving/display units, is that they can reduce restocking downtime. Right now, when displays or products need to be set out or moved, that display is taken out of commission while old merchandise is packed up and new merchandise is put out. Instead, by using these new mobile smart shelving unit/displays, employees could configure and stock them in the backroom and then they can be wheeled out onto the sales floor (i.e., deployed), while the old display could be wheeled to the back storage area, greatly reducing downtime during restocking. These mobile smart shelving units would also fit perfectly into "pop-up shop" retail applications, where the location and duration of displaying particular merchandise is flexible and retailers need to frequently adapt and adjust their retail spaces.

BRIEF SUMMARY OF THE INVENTION

The present disclosure includes disclosure of a mobile battery powered smart shelving unit, comprising: a wheeled frame having a plurality of reconfigurable shelves for receiving merchandise items thereon; a battery to provide electrical power for any electrical componentry on the smart shelving unit; a computer and Wi-Fi module configured for wireless communication with a central computer hub to exchange information with the central computer hub; at least one display screen in communication with the computer and the Wi-Fi module, for displaying information related to the merchandise items placed on the plurality of reconfigurable shelves; a low frequency Bluetooth module in communication with the computer and configured to communicate with other low frequency Bluetooth devices within range; and at least one RFID reader/scanner in communication with the computer and configured to detect a presence or absence of merchandise RFID tags within merchandise, so that when the merchandise is changed, the at least one RFID reader/scanner can identify that particular merchandise change and notify the computer to update the display with new merchandise information.

The present disclosure also includes disclosure of the smart shelving unit, further comprising an interactive touch screen for use by customers.

The present disclosure also includes disclosure of the smart shelving unit, further comprising a plurality of additional RFID readers/scanners positioned below, or within, each reconfigurable shelf of the plurality of configurable shelves.

The present disclosure also includes disclosure of the smart shelving unit, wherein the battery is rechargeable and is not removable from the smart shelving unit.

The present disclosure also includes disclosure of the smart shelving unit, wherein the battery is removable from the smart shelving unit for swapping or recharging.

The present disclosure also includes disclosure of the smart shelving unit, wherein the low-frequency Bluetooth module communicates with a plurality of other low-frequency Bluetooth modules on other smart shelving units to track and monitor locations of the other smart shelving units simultaneously to optimize retail efficiency.

The present disclosure also includes disclosure of the smart shelving unit, wherein the low frequency Bluetooth module is configured to communicate with cell phones of customers via a store app to monitor the customers near a particular smart shelving unit.

The present disclosure also includes disclosure of the smart shelving unit, wherein the low frequency Bluetooth module and the computer are configured to coordinate and send messages to customers based upon a customer's time spent in proximity to the smart shelving unit.

The present disclosure also includes disclosure of the smart shelving unit, wherein the low frequency Bluetooth module communicates with a plurality of the other low frequency Bluetooth modules around a retail environment to determine a customer's proximity to a particular smart shelving unit within a range of about 2 feet.

The present disclosure also includes disclosure of the smart shelving unit, forming part of a system, the system further comprising the central computer hub, wherein the central computer hub is configured to monitor a plurality of smart shelving units to continually update merchandise information, quantity, price, marketing and/or advertising information on the display, and is further configured to notify store employees when one or more of the smart shelving units need restocking or clean up.

The present disclosure also includes disclosure of the smart shelving unit, wherein the computer, the Wi-Fi module, and the central computer hub are configured to further communicate with a customer loyalty program to target specific merchandise to specific customers by follow-up email when a customer has not purchased a particular item.

The present disclosure also includes disclosure of the smart shelving unit, further comprising a camera and motion sensor.

The present disclosure also includes disclosure of the smart shelving unit, wherein the smart shelving unit is configured as a beverage cart for selling coffee and/or other drinks.

The present disclosure also includes disclosure of a system for optimizing retail operations, comprising: a central computer hub in wireless communication with a computer and Wi-Fi module on at least one smart shelving unit; and at least one smart shelving unit, comprising: a wheeled frame having a plurality of reconfigurable shelves for receiving merchandise items thereon; a battery to provide electrical power for any electrical componentry on the smart shelving unit; a computer and Wi-Fi module configured for wireless communication with the central computer hub for exchanging information with the central computer hub; at least one display screen in communication with the computer and the Wi-Fi module, for displaying information related to the merchandise items placed on the plurality of reconfigurable shelves; at least one low frequency Bluetooth module in communication with the computer and configured to communicate with other low frequency Bluetooth devices within range; and at least one RFID reader/scanner in communication with the computer and configured to detect a presence or absence of merchandise RFID tags within merchandise, so that when the merchandise is changed, the at least one RFID reader/scanner can identify that particular merchandise change and notify the computer to update the display with new merchandise information.

The present disclosure also includes disclosure of a method for optimizing retail operations using smart shelving units, comprising: providing at least one smart shelving unit, comprising: a wheeled frame having a plurality of reconfigurable shelves for receiving merchandise items thereon; a battery to provide electrical power for any electrical componentry on the smart shelving unit; a computer and Wi-Fi module configured for wireless communication with a central computer hub for exchanging information with the central computer hub; at least one display screen in communication with the computer and the Wi-Fi module, for displaying information related to merchandise items on the at least one smart shelving unit; a low frequency Bluetooth module in communication with the computer and configured to communicate with other low frequency Bluetooth devices within range; and at least one RFID reader/scanner in communication with the computer and configured to detect a presence or absence of merchandise RFID tags within merchandise, so that when merchandise is changed, the at least one RFID reader/scanner can identify that particular merchandise change and notify the computer to update the display with new merchandise information; placing merchandise having an RFID tag onto the smart shelving unit, wherein the at least one RFID reader/scanner detects a particular RFID tag and communicates that RFID tag information to the computer; exchanging information wirelessly between the computer, the Wi-Fi module, and the central computer hub, wherein the information relates to merchandise; and displaying merchandise information on the at least one display of the smart shelving unit.

The present disclosure also includes disclosure of a method, further comprising maintaining communication between the computer, the Wi-Fi module, and the central computer hub to continually monitor merchandise information and update the at least one display with information about merchandise on the smart shelving unit.

The present disclosure also includes disclosure of a method, further comprising the low-frequency Bluetooth module detecting a customer's cell phone signal via a store app to pinpoint a customer's location and sending push or text notifications to a customer's cell phone based on their location relative to the smart shelving unit.

The present disclosure also includes disclosure of a method, wherein a customer's cell phone signal may further provide data on an amount of time a customer spends near the smart shelving unit.

The present disclosure also includes disclosure of a method, wherein a customer's cell phone signal, the RFID reader/scanner, and the low frequency Bluetooth module on the smart shelving unit may all operate cooperatively to further provide data on which particular merchandise item a customer selected.

The present disclosure also includes disclosure of a method, wherein information on whether or not a customer purchased a particular merchandise item is relayed to the central computer hub and then later used to market or further advertise that particular merchandise item to a customer.

BRIEF DESCRIPTION OF THE DRAWINGS

The disclosed embodiments and other features, advantages, and disclosures contained herein, and the matter of attaining them, will become apparent and the present disclosure will be better understood by reference to the following description of various exemplary embodiments of the present disclosure taken in conjunction with the accompanying drawings, wherein.

Figure 2:
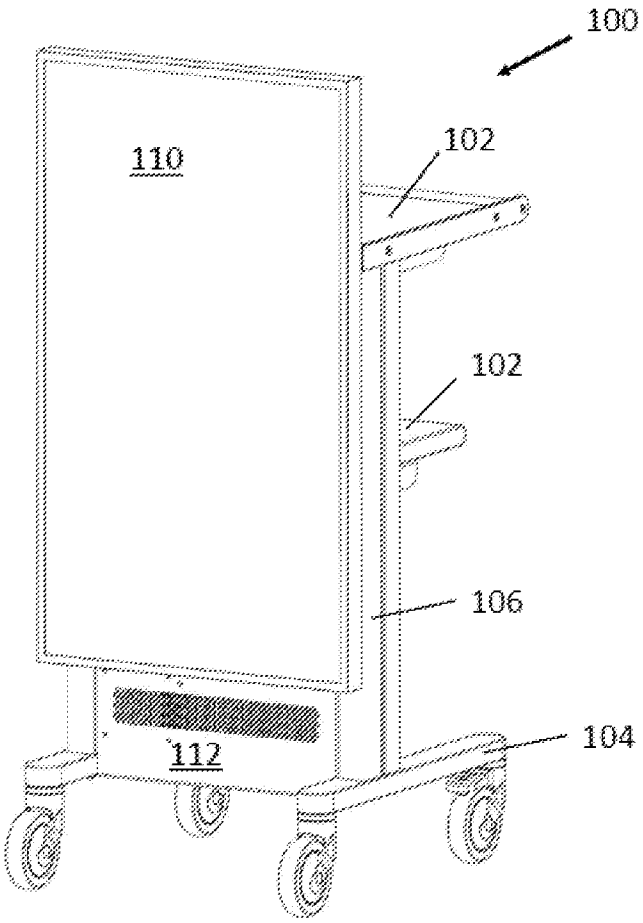
FIG. 2 illustrates a forward perspective view of a smart shelving unit with a large marketing screen/display thereon.
Figure 1:
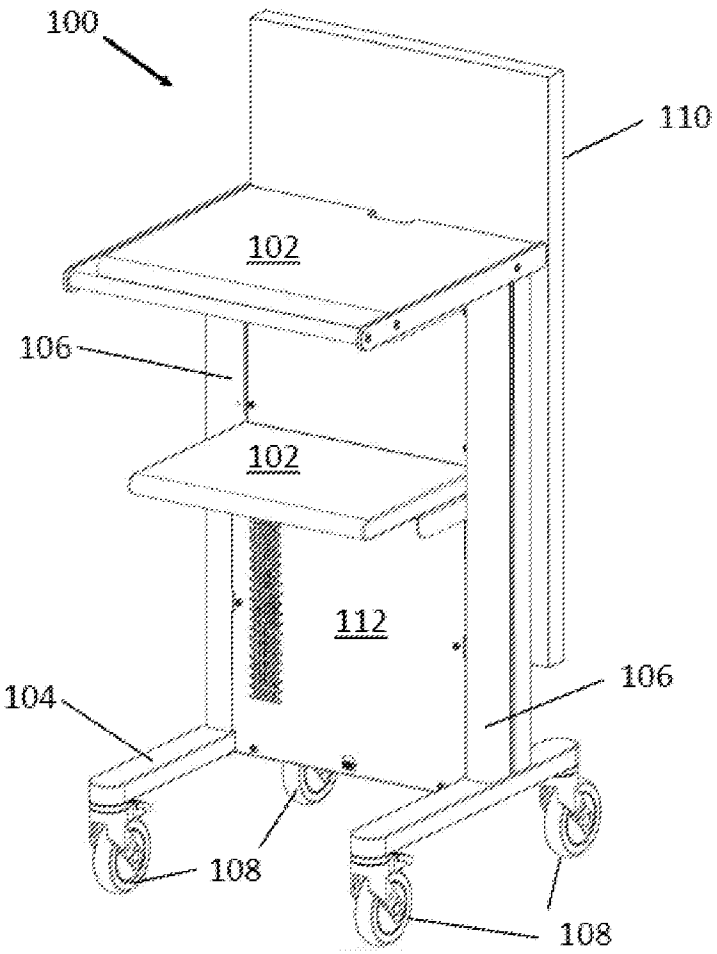
FIG. 1 illustrates a rear perspective view of a smart shelving unit with a large marketing screen/display thereon.
Figure 4:
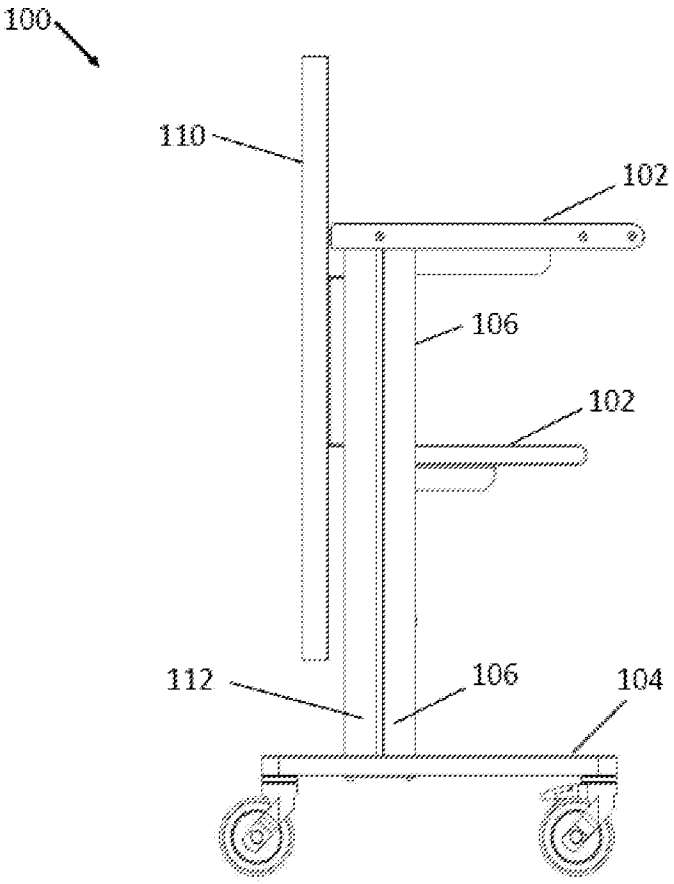
FIG. 4 illustrates a side view of a smart shelving unit having a marketing screen/display thereon.
Figure 3:
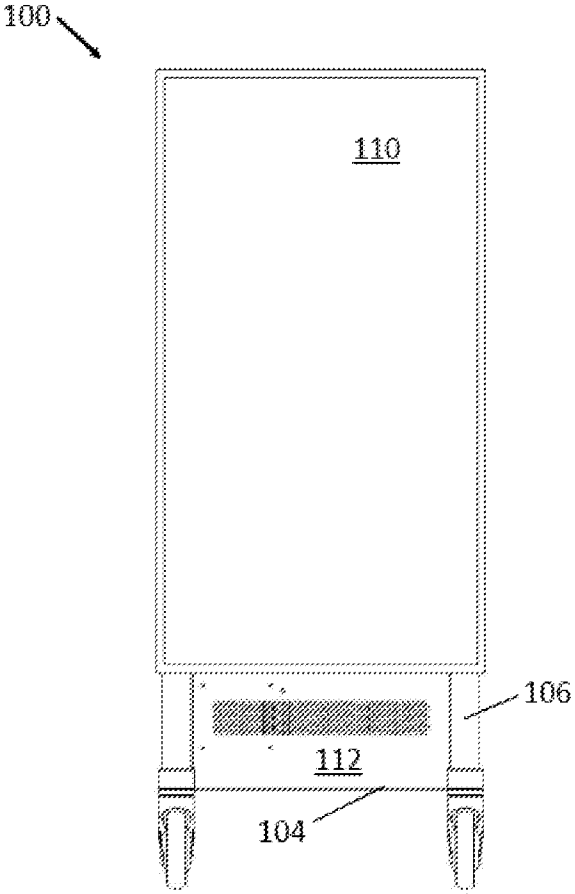
FIG. 3 illustrates a front view of a smart shelving unit having a marketing screen/display thereon.

As such, an overview of the features, functions and/or configurations of the components depicted in the various figures will now be presented. It should be appreciated that not all of the features of the components of the figures are necessarily described and some of these non-discussed features (as well as discussed features) are inherent from the figures themselves. Other non-discussed features may be inherent in component geometry and/or configuration. Furthermore, wherever feasible and convenient, like reference numerals are used in the figures and the description to refer to the same or like parts or steps. The figures are in a simplified form and not to precise scale.

DETAILED DESCRIPTION

For the purposes of promoting an understanding of the principles of the present disclosure, reference will now be made to the embodiments illustrated in the drawings, and specific language will be used to describe the same. It will nevertheless be understood that no limitation of the scope of this disclosure is thereby intended.

The present disclosure includes various mobile battery powered smart shelving units having a display and/or television screen(s), systems, and methods for operating these mobile battery powered smart shelving units. These mobile battery powered smart shelving units may generally include any combination of at least the following features/accessories: a mobile and reconfigurable shelf and/or rack unit (such as for hanging clothing merchandise), a low frequency Bluetooth module(s), a computer, an RFID reader/scanner (working in cooperation with RFID tags), display(s)/touchscreen(s), television(s), monitor(s), handheld computer(s), Wi-Fi modules, a camera, motion sensor, battery or other onboard power supply, lights, speakers, GPS modules, tablets, smartphones, point-of-sale devices, receipt printers, credit card readers, etc.

In some embodiments, these mobile battery powered smart units may also display, demonstrate, and sell food and/or beverage products. In these embodiments, the mobile battery powered units herein may further include any combination of, at least, the following features/accessories: a tablet, a phone, a point of sales machine, printer, credit card reader, coffee machines, refrigerators, freezers, storage areas, taps/fountains for drinks, cups, lids. It should be understood that any of the mobile battery powered smart shelving units and food & beverage distribution units or carts are not limited to the embodiments shown herein, as they may vary in look, size, shape, and accessories based upon each customer's requirements.

In a first embodiment, as shown in FIGS. 1-4, a mobile battery powered smart shelving unit 100 (as referred to herein as a 'smart shelving unit' 100) is generally shaped as a wheeled rectangular frame 106 (having a vertical structural portion, also 106) having multiple reconfigurable shelves 102 thereon, a display 110 or other interactive marketing display 110 at a comfortable viewing height, and a wheeled (108) base portion 104 coupled to the vertical frame 106. The base portion 104 may generally comprise a rectangular metal (or other rigid structural material) frame 106 having wheels or casters 108 thereon for rolling transport of the smart shelving unit 100.

As shown in FIGS. 1-4, a first embodiment of a smart shelving unit 100 may have 4 wheels 108 for transport, but any number, size and shape of wheels 108 may be used herein. Additionally, the wheels 108 may also be lockable, and/or retractable, or capable of being lockably recessed into or hidden (such as within rectangular metal frame 106), as an added security feature to prevent unauthorized or undesirable movement of the mobile battery powered smart shelving unit 100.

As shown in FIGS. 1-4, the vertical frame portion 106 of the smart shelving unit 100 may further comprise several horizontal shelves 102. The horizontal shelves 102 may be adjustable and/or reconfigurable to provide more (or less) storage space between each shelf 102. In alternative embodiments, the horizontal shelves 102 may be replaced (or used in combination with) hanging rods, bars, or racks, such as for hanging clothing merchandise.

Additionally, the shelving unit 100 may include at least one display screen 110, having any size and shape and securely attached to vertical frame 106, for displaying merchandise information, marketing, advertising, and/or entertainment. This at least one display screen 110 may be an interactive touch screen 130 (such as an LED/LCD/OLED/etc.) and/or may be a viewing screen, such as a large television, for example. The display 110 may be used for advertising, marketing, and/or entertainment purposes to show advertisements or other information related to the merchandise stocked on the horizontal shelves 102. The display 110 may be customizable with any number of options, depending upon the purpose and location of the display 110 and the customer's specific needs. The display 110 may be powered by a battery (disposed on the smart shelf unit 100 or within the frame 106) and may also display other useful retail information, such as price, item quantities, sizes remaining, etc. In some embodiments, the display 110 may be a unit capable of displaying a still-photo or picture even when in a minimal power or energy-saving state, such as a Samsung Frame Television, for example. In this embodiment, the display 110 may also still continue displaying relevant product or merchandise information, even if the battery is running low.

In addition to at least one display 110, or multiple displays 110 as shown in FIGS. 6-11, the smart shelving unit 100 may further include a smaller touch screen 130, such as shown in FIGS. 8-11. This smaller touch screen 130 may be securely mounted to the smart shelf unit 100 at an easily accessed height for customers. The smaller touch screen 130 may also be interactive touch screen for use by customers, such as for a more interactive advertising or marketing experience. Additionally, this smaller touch screen 130 may also be used by customers to make a purchase, obtain additional product information, watch product demonstrations, select customer service plans, warranty plans, etc.

Figure 5:
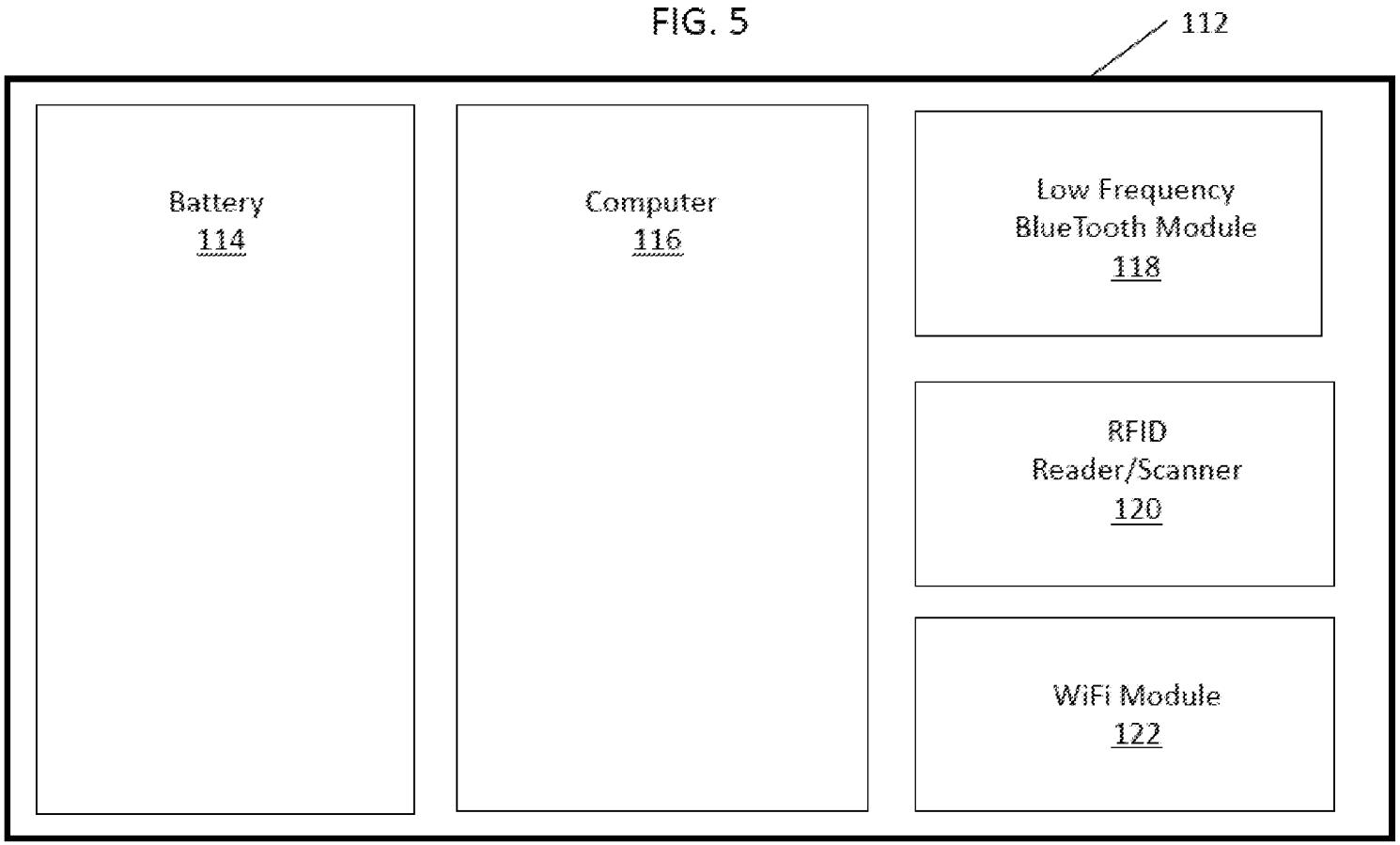
FIG. 5 illustrates an exemplary schematic representation of the electrical componentry within the smart shelving unit.

As best shown in FIGS. 1-5, a portion of the vertical frame 106 may further include electrical componentry (shown generally as within compartment 112, recessed within lower portion of frame 106). As shown in FIG. 5, the electrical componentry within compartment 112, may include, at least: a battery 114, computer 116, low frequency Bluetooth module 118, RFID scanner 120, WiFi module 122, etc. It should be understood that a smart shelving unit 100 may also comprise any number, or a plurality of, batteries 114, computers 116, low frequency Bluetooth modules 118, RFID readers/scanners 120, Wi-Fi modules 122, etc.

As shown in FIG. 5, the battery 114 (shown generally as box 114 within compartment 112) may provide electrical power for many, or all of, the electrical components on the smart shelving unit 100, such as, at least a large viewing screen or display 110, advertising and/or marketing demos, lights, speakers, a computer 116, low frequency Bluetooth module 118, RFID scanner 120, WiFi module 122, touch screen display 130, etc. It should be understood that electronic componentry is housed within a secure compartment (such as 112) within a portion of the smart shelving unit 100 and may be accessed via a door or other opening and thus, may also be lockable or otherwise secured, to prevent theft and/or damage to electronic componentry, etc. FIGS. 1-4 also illustrate air holes/vents within vertical frame 106 to provide improved ventilation for cooling of electronic componentry therein.

In some embodiments, the smart shelving units 100 may have a nonremovable rechargeable battery 114 and thus may also have a charging port thereon (not shown), electrically coupled to the battery 114, for charging the battery 114, such as by plugging the smart shelving unit 100 into a wall outlet. In some embodiments, the battery 114 may be a lithium battery, for example, and may be large enough to provide battery power for at least 8-10 hours and/or the store hours of most retail stores. In other embodiments, the battery 114 may also be recharged, such as by plugging the smart shelving unit 100 and/or the battery 114 into a wall outlet. In some embodiments, the smart shelving unit 100 may be plugged into a wall outlet for charging during use (such as when a wall outlet happens to be conveniently close). Optionally, the smart shelving unit 100 can also be charged in advance and then run off of battery power for an extended length of time, thus eliminating the need to be close to a wall outlet during operation. In some embodiments, the smart shelving units 100 may also charge simultaneously when stored adjacent one together, such as in a daisy chain, for example. Employees can recharge and/or replace batteries 114 between shifts, for example, and battery 114 life is anticipated to be customizable for consumer needs.

In some embodiments, the smart shelving unit 100 may have a slide out, or removable, battery 114. In this embodiment, the battery 114 may be housed within a compartment 112 of vertical frame 106, best shown in FIGS. 1-4. In this embodiment, the battery 114 may be accessed by opening the storage compartment 112 of the vertical frame 106 and sliding out the battery 114 for convenient swapping and/or charging of the battery 114, for example.

As shown in FIG. 5, the computer 116 may be compact enough to fit within compartment 112 of the smart shelving unit 100, while still being large enough for extended run time. Computer 116 may be electrically coupled to battery 114 and/or may include its own battery. Computer 116 may further comprise a USB hub for coupling to other electronic devices, such as during maintenance updates, for example. The computer 116 could be a mini PC form factor, such as the Intel NUC series for example. The computer 116 may vary in processing power, memory capacity, and storage capacity, depending on the application. In one embodiment, the computer 116 may be tasked with taking the RFID inputs from displayed merchandise (such as via RFID reader/scanner 120), cross-referencing to a product database, and sending the corresponding photo or video to the display(s) 110 on the smart shelving unit 100.

As generally shown in FIG. 5, the computer 116 may further comprise, be in communication with, and/or operate in conjunction with a Wi-Fi module 122 and/or low frequency Bluetooth module 118, to communicate with other computers and/or a central control hub, control center, or CPU to provide information about the smart shelving unit 100 (such as inventory numbers, inventory location, stocking information, etc.). The low frequency Bluetooth module 118, computer 116, and central control hub, or CPU computer may all work together to increase store and employee efficiency. The RFID reader/scanner 120 may provide real-time (i.e., immediate and/or ongoing) inventory updates, which can then be relayed to a control center or CPU to automatically order more inventory and/or redirect employees to areas requiring the most urgent attention. Additionally, information received from the low frequency Bluetooth module 118 may be used track the smart shelf unit 100 locations, maintain awareness of multiple smart units 100 (i.e., a fleet), and to optimize sales, such as redirecting the location of the smart shelving units 100 to areas of the store with more customers, higher sales, etc.

In some embodiments, the RFID reader/scanner 120 may be located within electronic componentry compartment 112 of the smart shelving unit 100, as shown in FIG. 5. However, in other embodiments, an RFID reader/scanner 120 may be located below (or within) each horizontal shelf unit 102. In this embodiment, a single smart shelf unit 100 having a plurality of horizontal shelf units 102 would include also include a plurality of RFID reader/scanners 120 positioned below or within each horizontal shelf unit 102. Positioning the RFID readers/scanners 120 closer to the merchandise is desirable for improved data scanning accuracy. In this case, each piece of inventory or merchandise (such as clothing, etc.) would contain its own RFID tag. When the piece of merchandise is removed from the shelf, the RFID reader/scanner 120 would automatically register this data and relay it to the computer 116 within the smart shelving unit 100. The inventory data on computer 116 can then be relayed back to a central hub (such as within a central computer or CPU within a retail store) via the WiFi module 122 of the smart shelving unit 100.

Utilizing the RFID reader/scanner 120 (or multiple RFID readers/scanners 120 located within a smart shelving unit 100, such as within horizontal shelves 102) and RFID tags (such as on each piece of merchandise), the computer 116 could then recognize what items are being displayed. After the computer 116 recognizes the items being displayed, it may then communicate with a central control hub and/or marketing database, and could begin advertising that specific item (i.e., piece of merchandise) on the smart shelving unit 100. When the merchandise on the smart shelving unit 100 needs to be replaced with something new, the RFID reader/scanner 120 (or multiple RFID readers/scanners located within horizontal shelves 102) would immediately recognize the new RFID tags (on the new merchandise) and begin advertising the new merchandise, as well as updated price, etc., on the display 110. This will significantly improve retail store operations, and employee efficiency, by reducing setup times for new merchandise and/or retail displays, as well as improving accuracy of merchandise information.

In some other embodiments, a horizontal shelf 102 (or other upper area of the smart shelving unit 100) may further comprise a camera and/or motion sensor (not shown) to detect and/or monitor customer interest in the merchandise on the smart shelving unit 100. The camera and/or sensor may simply count the number of customers who pause near the smart shelving unit 100 to determine general customer interest in the merchandise to help maintain an appropriate inventory supply.

However, in other embodiments, if a customer has previously downloaded the store's app on their personal phone cell, then the smart shelving unit's 100 low frequency Bluetooth module 118 can detect that customer's cell phone signal. In this case, the low frequency Bluetooth module 118 may recognize how long the customer stops near the smart shelving unit 100, thus revealing data on how interested a particular consumer is in specific merchandise. Once a customer's cell phone is detected, then the low frequency Bluetooth module 118 and computer 116 can operate together to further determine that cell phone's precise location. This information on the customer's location may further be combined with whether or not the customer ultimately purchases certain merchandise. This information may then also be used in cooperation with a store's loyalty program, and the store's app, to send follow-up emails, text messages, and/or push notifications to further market that specific merchandise to that particular customer. For example, if the customer did not ultimately purchase an item, but spent a good amount of time near that item, the customer may later be sent a coupon to further market or advertise that item to the customer.

In this manner, the low frequency Bluetooth module 118 may also send push notifications, containing coupons and/or advertisement to customers, based upon data received from a smart shelving unit 100. For example, if a person walks into an Example Retail Store (and they have already downloaded Example Retail Store's app on their phone,), when they walk within X feet of a smart shelving unit 100, they could receive a push notification (through the Example Retail Store's app on their phone) that says, "Welcome to Example Store! Here's a list of today's deals . . . " Additionally, if the customer spends more than X seconds near a smart shelving unit 100, the low frequency Bluetooth module 118 and computer 116 within the smart shelving unit 100 could remember that information. If the customer does not ultimately end up buying the merchandise/item they paused near, then the app could remind them about the merchandise/item later and possibly send an additional coupon for that merchandise/item. It should be understood, that the exemplary X distances and X times noted herein above are customizable (such as via computer 116 algorithms) to be any distance or time, as desired by a retail store.

In another embodiment, the low frequency Bluetooth module 118 could be used in combination with many other low frequency Bluetooth modules placed all around a retail store. In this embodiment, the low frequency Bluetooth module 118 could more precisely locate people (having a cell phone with the store's app) within the store and in relation to specific smart shelving unit's 100. In some cases, the low frequency Bluetooth module 118 may be able to pinpoint a cell phone's (or person's) location within approximately 2 feet. The low frequency Bluetooth module 118 may also then log or note if the person remained near a particular smart shelving unit 100 for more than 30 seconds, and/or measure how long a person stayed there before moving on.

Building upon this data, the RFID reader/scanner 120 can also log which specific items were picked up from the smart shelving unit 100 and/or which items were put back. The computer 116 can process this information and cross reference this information with a central computer hub and the store's loyalty program to further determine if a customer ultimately purchased an item or not. If the customer did not purchase the item, the computer 116 and/or central computer hub can make a note of this and send a follow-up message (email, text, push notification, etc.) to the customer with a coupon, reminder, etc. to further market the item.

Figure 7:
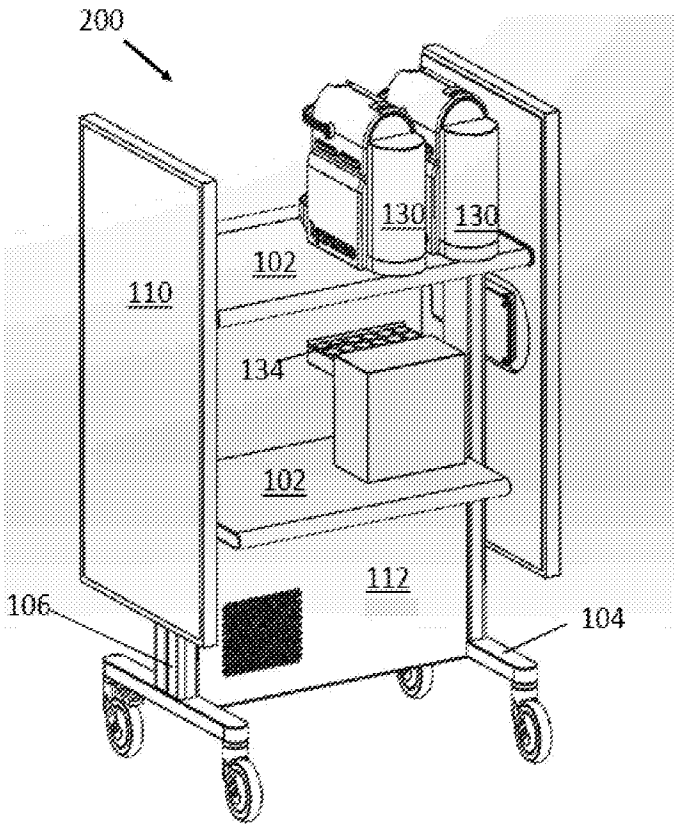
FIG. 7 illustrates a rear perspective view of a smart shelving unit with two marketing screens/displays thereon.
Figure 6:
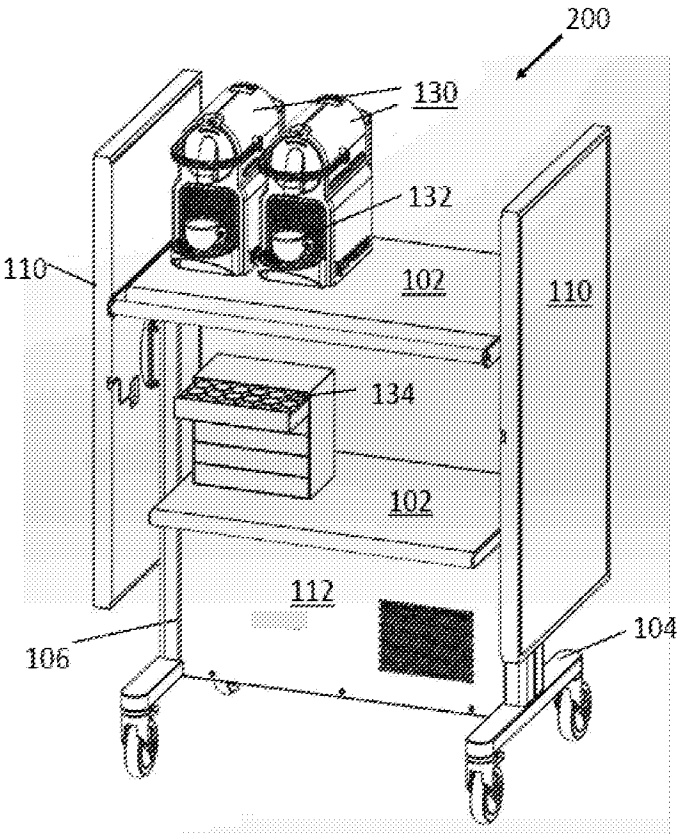
FIG. 6 illustrates a front perspective view of a smart shelving unit with two marketing screens/displays thereon.
Figure 9:
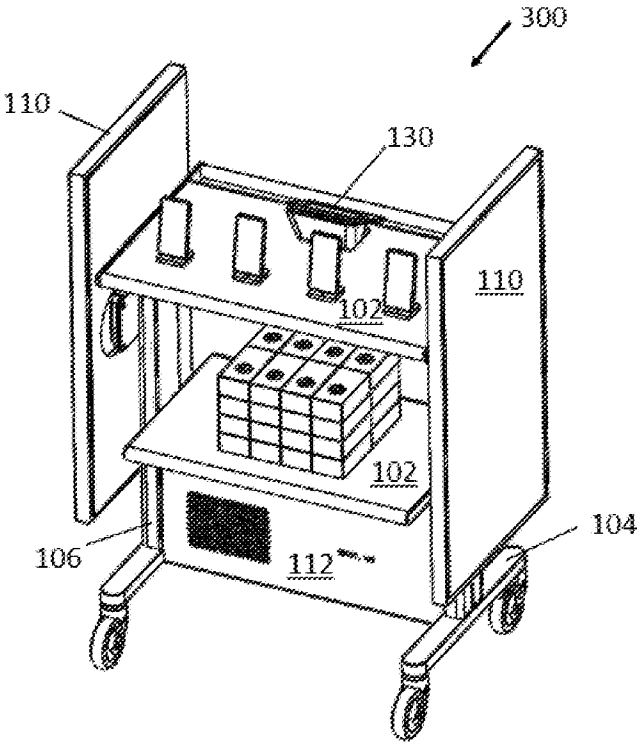
FIG. 9 illustrates a rear perspective view of a larger smart shelving unit with two marketing screens/displays, an interactive touch screen, and exemplary merchandise for demonstration thereon.
Figure 8:
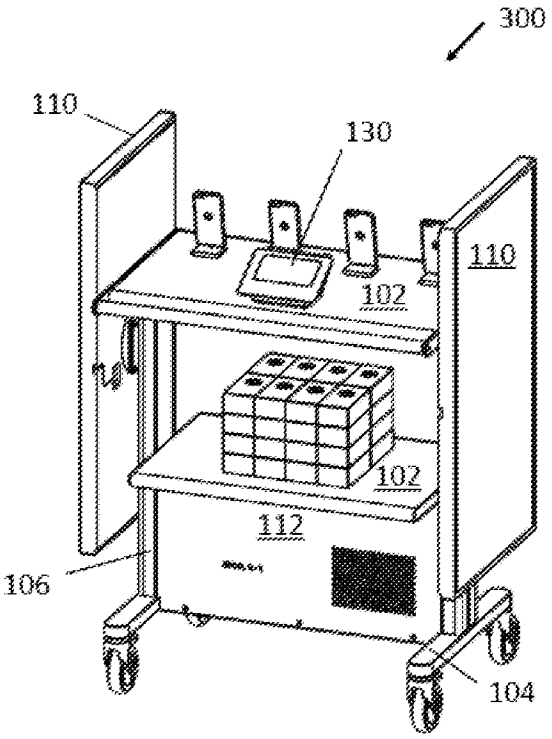
FIG. 8 illustrates a forward perspective view of a larger smart shelving unit with two marketing screens/displays, an interactive touch screen, and exemplary merchandise for demonstration thereon.
Figure 11:
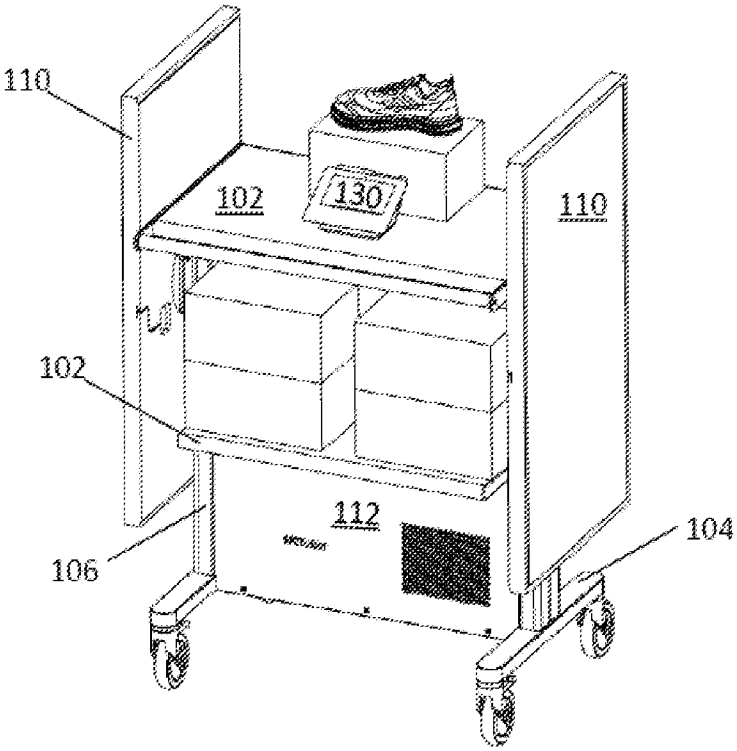
FIG. 11 illustrates an exemplary embodiment of a larger smart shelving unit with two marketing screens/displays, an interactive touch screen, and exemplary merchandise for demonstration thereon.
Figure 10:
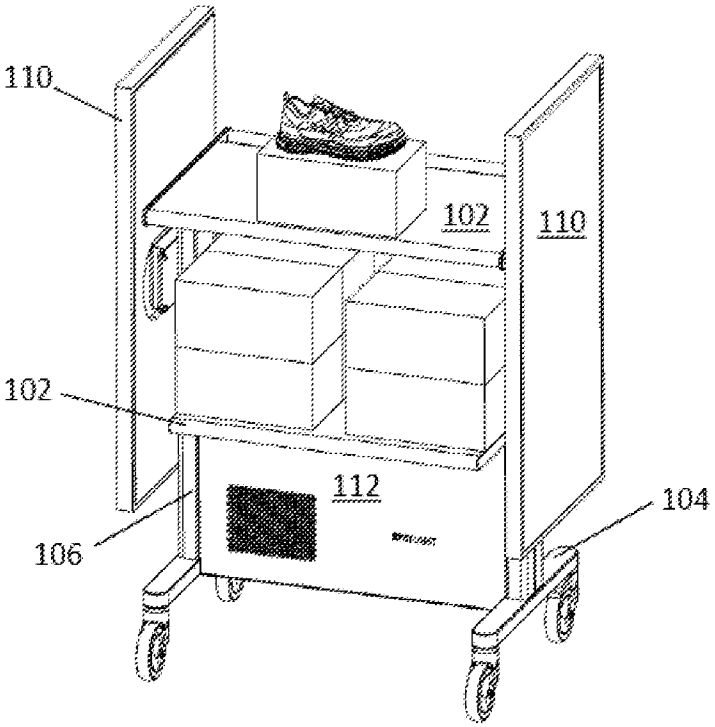
FIG. 10 illustrates an exemplary embodiment of a larger smart shelving unit with two marketing screens/displays, an interactive touch screen, and exemplary merchandise for demonstration thereon.

It should be understood that the smart shelving units 100 herein may be used to display any size, shape, or type of merchandise, including food and/or beverage items (as will be described further herein below). FIGS. 6 & 7 illustrate an exemplary embodiment of the smart shelving unit 200 being used to display and sell beverages, such as coffee, for example. Similarly, FIGS. 8 & 9 illustrate an exemplary embodiment of the smart shelving unit 300 being used to display, demonstrate, and sell cell phone merchandise. FIGS. 10 & 11 illustrate an exemplary embodiment of the smart shelving unit 400 being used to display and sell footwear merchandise.

In the embodiment 200, shown in FIGS. 6 & 7, the smart shelving unit 200 may take the form of a smart shelving unit 200 with the inventory or merchandise being coffee cups, coffee pods, K-cups, etc., instead of clothing. In this embodiment, the upper horizontal shelf area 102 of the smart shelving unit 200 may also comprise (at least one) beverage distribution fountain 130 mounted thereon, as well as beverage related supplies, such as cups 132, lids, coffee pods, K-cups, and additional coffee add-ons (such as stirring sticks, sugar, honey, creams, lemon slices etc.). Additionally, the smart shelving unit 200 may further comprise coffee and/or espresso machines 130, beverage warming surfaces, milk steamers, coffee bean grinder, refrigerator, freezer, cooler, mixers, blenders, ice maker/distributor, and other electric dispensers, etc. In the case of a beer or alcohol dispensing beverage cart (not shown), the cart may further comprise a kegerator(s), carbonation machine(s), mixers, blenders, ice maker/distributor, etc. These smart shelving unit 200 may be customized to meet specific customer needs and may be equipped with any number of beverage making machines or supplies.

With continuing reference to FIGS. 6 & 7, the smart shelving unit 200 may also include electronic componentry within a compartment 112 within the frame 106. The electronic componentry may include: a battery 114, onboard computer 116, interactive touch screen/computer (not shown), low frequency Bluetooth module 118, RFID scanner/reader 120, WiFi module 122, credit card reader (not shown), printer (not shown), large viewing screen 110, etc. In use, the electronic componentry of the smart shelving unit 200 would operate as described above. The battery 114 would provide power to the electronic components 112. The RFID reader/scanner 120 would detect when an item, such as a coffee cup 132 or K-cup 134, is removed from the smart shelving unit 200, thus making a note of this item and its cost to charge a customer. The low frequency Bluetooth module 118 can identify a specific customer via a customer loyalty program or the retail store's app (as described above) and then, in combination with computer 116, charge the customer for the coffee purchase. The use of the low frequency Bluetooth 118 (in combination with the RFID reader/scanner 120, computer 116, and WiFi module 122) will greatly improve beverage purchasing efficiency, providing customers with a better purchasing experience. The touch screen display 130 may be used by consumers to pay for a beverage purchase, learn more about beverage choices, and/or make beverage choices. Additionally, the large display 110, or two large displays 110, can display marketing and/or entertainment information while the customer is getting their beverage from the smart shelving unit 200.

FIGS. 8 & 9 illustrate an exemplary embodiment of the smart shelving unit 300 being used to display, demonstrate, and sell cell phone merchandise. In this embodiment, the interactive touch screen 130 may be used by customers to purchase the merchandise item directly from the smart shelf unit 300 and/or to for interactive product demonstrations and marketing purposes. FIGS. 10 & 11 illustrate an exemplary embodiment of the smart shelving unit 400 being used to display and sell footwear merchandise. In both of the smart shelf unit 300, 400 embodiments, the interactive touch screen 130 may be used by customers for interactive product demonstrations and/or marketing purposes, as well as to provide similar product suggestions, or to provide merchandise stock availability etc.

While various embodiments of devices and systems and methods for using the same have been described in considerable detail herein, the embodiments are merely offered as non-limiting examples of the disclosure described herein. It will therefore be understood that various changes and modifications may be made, and equivalents may be substituted for elements thereof, without departing from the scope of the present disclosure. The present disclosure is not intended to be exhaustive or limiting with respect to the content thereof.

Further, in describing representative embodiments, the present disclosure may have presented a method and/or a process as a particular sequence of steps. However, to the extent that the method or process does not rely on the particular order of steps set forth therein, the method or process should not be limited to the particular sequence of steps described, as other sequences of steps may be possible. Therefore, the particular order of the steps disclosed herein should not be construed as limitations of the present disclosure. In addition, disclosure directed to a method and/or process should not be limited to the performance of their steps in the order written. Such sequences may be varied and still remain within the scope of the present disclosure.

The invention claimed is:

1. A mobile battery powered smart shelving unit to improve retail efficiency, comprising:

a wheeled frame having a plurality of reconfigurable shelves for receiving merchandise items thereon;

a battery disposed within an equipment compartment in a lower portion of the frame, the battery configured to provide electrical power for any electrical componentry on the smart shelving unit;

a computer disposed within the equipment compartment, and a Wi-Fi module configured for wireless communication with a central computer hub to exchange information with the central computer hub;

at least one display screen in communication with the computer and the Wi-Fi module, for displaying information related to the merchandise items placed on the plurality of reconfigurable shelves;

an interactive touch screen configured for use by customers to purchase the merchandise from the smart shelf unit, and the interactive touch screen smaller than the at least one display screen and mounted to the smart shelf unit at an easily accessed height for customers;

a low frequency Bluetooth module in communication with the computer and configured to communicate with other low frequency Bluetooth devices within range; and at least one RFID reader/scanner mounted to the smart shelving unit and in communication with the computer, the RFID reader/scanner configured to detect RFID tags associated with merchandise placed on the plurality of reconfigurable shelves, wherein the computer disposed within the equipment compartment is configured, in response to detecting via the RFID reader/scanner a newly appearing RFID tag corresponding to merchandise newly placed on one of the plurality of reconfigurable shelves, to process information associated with the newly appearing RFID tag and to control the at least one display screen to present information associated with the newly placed merchandise;

the RFID reader/scanner configured to automatically register a removal of the merchandise from the shelf and relay this registration to the computer to provide real-time inventory updates;

wherein the low-frequency Bluetooth module communicates with a plurality of other low-frequency Bluetooth modules on other mobile battery powered smart shelving units to track and monitor locations of the other mobile battery powered smart shelving units simultaneously to optimize retail efficiency;

wherein the low-frequency Bluetooth module is configured to detect a signal from a customer device located within a threshold distance from the smart shelving unit for at least a threshold duration;

wherein the customer device is associated with a particular customer via a store application installed on the customer device;

wherein the RFID reader/scanner is configured to detect removal of an RFID-tagged merchandise item from the smart shelving unit;

wherein the computer is configured to determine that the particular customer associated with the detected customer device interacted with the RFID-tagged merchandise item based on the detected removal of the RFID-tagged merchandise item and detection of the customer device within the threshold distance;

wherein the computer is configured to cross reference the removal of the RFID-tagged merchandise item with information from the central computer hub and the store application to determine whether the particular customer associated with the detected customer device purchased the RFID-tagged item; and wherein the computer and/or the central computer hub is configured to transmit a follow-up message to the customer device associated with the particular customer in response to determining that the RFID-tagged merchandise item was not purchased.

2. The smart shelving unit of claim 1, further comprising a plurality of additional RFID readers/scanners positioned below, or within, each reconfigurable shelf of the plurality of configurable shelves.

3. The smart shelving unit of claim 1, wherein the battery is rechargeable and is not removable from the smart shelving unit.

4. The smart shelving unit of claim 1, wherein the battery is removable from the smart shelving unit for swapping or recharging.

5. The smart shelving unit of claim 1, wherein the low frequency Bluetooth module is configured to communicate with cell phones of customers via a store app to monitor the customers near a particular smart shelving unit.

6. The smart shelving unit of claim 1, wherein the low frequency Bluetooth module and the computer are configured to coordinate and send messages to customers based upon a customer's time spent in proximity to the smart shelving unit.

7. The smart shelving unit of claim 1, wherein the low frequency Bluetooth module communicates with a plurality of the other low frequency Bluetooth modules around a retail environment to determine a customer's proximity to a particular smart shelving unit within a range of about 2 feet.

8. The smart shelving unit of claim 1, forming part of a system, the system further comprising the central computer hub, wherein the central computer hub is configured to monitor a plurality of smart shelving units to continually update merchandise information, quantity, price, marketing and/or advertising information on the display, and is further configured to notify store employees when one or more of the smart shelving units need restocking or clean up.

9. The smart shelving unit of claim 1, wherein the computer, the Wi-Fi module, and the central computer hub are configured to further communicate with a customer loyalty program to target specific merchandise to specific customers by follow-up email when a customer has not purchased a particular item.

10. The smart shelving unit of claim 1, further comprising a camera and motion sensor.

11. The smart shelving unit of claim 1, wherein the smart shelving unit is configured as a beverage cart for selling coffee and/or other drinks.

12. A system for optimizing retail operations, comprising:

a central computer hub in wireless communication with a computer and Wi-Fi module on at least one smart shelving unit; and at least one smart shelving unit, comprising:

a wheeled frame having a plurality of reconfigurable shelves for receiving merchandise items thereon;

a battery to provide electrical power for any electrical componentry on the smart shelving unit;

a computer and Wi-Fi module configured for wireless communication with the central computer hub for exchanging information with the central computer hub;

at least one display screen in communication with the computer and the Wi-Fi module, for displaying information related to the merchandise items placed on the plurality of reconfigurable shelves;

an interactive touch screen configured for use by customers to purchase the merchandise from the smart shelf unit, and the interactive touch screen smaller than the at least one display screen and mounted to the smart shelf unit at an easily accessed height for customers;

at least one low frequency Bluetooth module in communication with the computer and configured to communicate with other low frequency Bluetooth devices within range; and at least one RFID reader/scanner mounted to the smart shelving unit and in communication with the computer, the RFID reader/scanner configured to detect RFID tags associated with merchandise placed on the plurality of reconfigurable shelves, wherein the computer disposed within the equipment compartment is configured, in response to detecting via the RFID reader/scanner a newly appearing RFID tag corresponding to merchandise newly placed on one of the plurality of reconfigurable shelves, to process information associated with the newly appearing RFID tag and to control the at least one display screen to present information associated with the newly placed merchandise;

the RFID reader/scanner configured to automatically register a removal of the merchandise from the shelf and relay this registration to the computer to provide real-time inventory updates;

wherein the low-frequency Bluetooth module communicates with a plurality of other low-frequency Bluetooth modules on other mobile battery powered smart shelving units to track and monitor locations of the other mobile battery powered smart shelving units simultaneously to optimize retail efficiency;

wherein the low-frequency Bluetooth module is configured to detect a signal from a customer device located within a threshold distance from the smart shelving unit for at least a threshold duration;

wherein the customer device is associated with a particular customer via a store application installed on the customer device;

wherein the RFID reader/scanner is configured to detect removal of an RFID-tagged merchandise item from the smart shelving unit;

wherein the computer is configured to determine that the particular customer associated with the detected customer device interacted with the RFID-tagged merchandise item based on the detected removal of the RFID-tagged merchandise item and detection of the customer device within the threshold distance;

wherein the computer is configured to cross reference the removal of the RFID-tagged merchandise item with information from the central computer hub and the store application to determine whether the particular customer associated with the detected customer device purchased the RFID-tagged item; and wherein the computer and/or the central computer hub is configured to transmit a follow-up message to the customer device associated with the particular customer in response to determining that the RFID-tagged merchandise item was not purchased.

13. A method for optimizing retail operations using smart shelving units, comprising:

providing at least one smart shelving unit, comprising:

a wheeled frame having a plurality of reconfigurable shelves for receiving merchandise items thereon;

a battery to provide electrical power for any electrical componentry on the smart shelving unit;

a computer and Wi-Fi module configured for wireless communication with a central computer hub for exchanging information with the central computer hub;

at least one display screen in communication with the computer and the Wi-Fi module, for displaying information related to merchandise items on the at least one smart shelving unit;

an interactive touch screen configured for use by customers to purchase the merchandise from the smart shelf unit, and the interactive touch screen smaller than the at least one display screen and mounted to the smart shelf unit at an easily accessed height for customers;

a low frequency Bluetooth module in communication with the computer and configured to communicate with other low frequency Bluetooth devices within range; and at least one RFID reader/scanner mounted to the smart shelving unit and in communication with the computer, the RFID reader/scanner configured to detect RFID tags associated with merchandise placed on the plurality of reconfigurable shelves, wherein the computer disposed within the equipment compartment is configured, in response to detecting via the RFID reader/scanner a newly appearing RFID tag corresponding to merchandise newly placed on one of the plurality of reconfigurable shelves, to process information associated with the newly appearing RFID tag and to control the at least one display screen to present information associated with the newly placed merchandise;

the RFID reader/scanner configured to automatically register a removal of the merchandise from the shelf and relay this registration to the computer to provide real-time inventory updates;

wherein the low-frequency Bluetooth module communicates with a plurality of other low-frequency Bluetooth modules on other mobile battery powered smart shelving units to track and monitor locations of the other mobile battery powered smart shelving units simultaneously to optimize retail efficiency;

placing merchandise having an RFID tag onto the smart shelving unit, wherein the at least one RFID reader/scanner detects a particular RFID tag and communicates that RFID tag information to the computer;

exchanging information wirelessly between the computer, the Wi-Fi module, and the central computer hub, wherein the information relates to merchandise;

displaying merchandise information on the at least one display of the smart shelving unit;

detecting, via the low-frequency Bluetooth module, a signal from a customer device located within a threshold distance from the smart shelving unit for at least a threshold duration;

identifying the particular customer associated with the detected customer device via a store application installed on the customer device;

detecting, via the RFID reader/scanner, removal of an RFID-tagged merchandise item from the smart shelving unit;

determining that the particular customer associated with the detected customer device interacted with the RFID-tagged merchandise item based on (i) detection of the customer device within the threshold distance for at least the threshold duration and (ii) detection of removal of the RFID-tagged merchandise item;

cross-referencing the detected removal of the RFID-tagged merchandise item with information from the central computer hub and the store application to determine whether the particular customer purchased the RFID-tagged merchandise item; and transmitting a follow-up message to the customer device associated with the particular customer in response to determining that the RFID-tagged merchandise item was not purchased.

14. The method of claim 13, further comprising maintaining communication between the computer, the Wi-Fi module, and the central computer hub to continually monitor merchandise information and update the at least one display with information about merchandise on the smart shelving unit.

15. The method of claim 13, further comprising the low-frequency Bluetooth module detecting a customer's cell phone signal via a store app to pinpoint a customer's location and sending push or text notifications to a customer's cell phone based on their location relative to the smart shelving unit.

16. The method of claim 13, wherein a customer's cell phone signal may further provide data on an amount of time a customer spends near the smart shelving unit.

17. The method of claim 15, wherein a customer's cell phone signal, the RFID reader/scanner, and the low frequency Bluetooth module on the smart shelving unit may all operate cooperatively to further provide data on which particular merchandise item a customer selected.

18. The method of claim 13, wherein information on whether or not a customer purchased a particular merchandise item is relayed to the central computer hub and then later used to market or further advertise that particular merchandise item to a customer.

19. The mobile battery powered smart shelving unit of claim 1, wherein the computer is in communication with a central control hub to provide inventory information about the smart shelving unit such as inventory numbers, and stocking information;

wherein the inventory data on computer is relayed to the central control hub; and wherein the central control hub automatically orders more inventory of the merchandise.

* * * * *